US007290515B2

(12) United States Patent
Schmid

(10) Patent No.: US 7,290,515 B2
(45) Date of Patent: Nov. 6, 2007

(54) CAMSHAFT AND METHOD FOR PRODUCING A CAMSHAFT

(75) Inventor: Alois Schmid, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/518,567

(22) Filed: Sep. 8, 2006

(65) Prior Publication Data

US 2007/0006834 A1 Jan. 11, 2007

Related U.S. Application Data

(63) Continuation-in-part of application No. PCT/EP2005/002339, filed on Mar. 5, 2005.

(30) Foreign Application Priority Data

Mar. 5, 2005 (DE) ..... 10 2004 011 815

(51) Int. Cl.
*F01L 1/04* (2006.01)

(52) U.S. Cl. ..... 123/90.6; 123/90.27; 29/888.1

(58) Field of Classification Search ..... 123/90.15, 123/90.16, 90.17, 90.18, 90.27, 90.31, 90.6; 29/888.1

See application file for complete search history.

(56) References Cited

U.S. PATENT DOCUMENTS 5,272,930 A 12/1993 Nakamura et al.
7,025,024 B2 * 4/2006 Merz ..... 123/90.27

FOREIGN PATENT DOCUMENTS

DE 37 17 190 12/1988
DE 41 21 951 12/1992
DE 42 09 153 4/1993
DE 195 20 306 12/1996
DE 100 61 042 6/2002
EP 0 265 663 5/1988
EP 0 282 166 9/1988
EP 0 313 565 5/1989
EP 0 328 009 8/1989
EP 0 374 389 6/1990
EP 0 374 394 6/1990
EP 0 459 466 12/1991
EP 0 516 946 12/1992
EP 0 580 200 7/1994
EP 0 663 248 7/1995
EP 0 650 550 1/1996
EP 0 839 990 5/1998
EP 0 856 642 8/1998
EP 0 730 705 7/1999
EP 0 970 293 1/2000

* cited by examiner

*Primary Examiner*—Ching Chang
(74) *Attorney, Agent, or Firm*—Klaus J. Bach

(57) ABSTRACT

In a camshaft for an internal combustion engine having a cam disk support shaft, to which a plurality of cam disks and a drive wheel are attached, the outer radius of the cam disk support shaft varies continuously in those sections in which the cam disks are attached. The cam disks have bores whose inner radius varies continuously and the cam disk support shaft is alternately provided with elevations and depressions in those sections in which the cam disks are attached, the elevations and depressions forming a wedge-shaped curve profile about the circumference of the section of the cam disk support shaft The elevations continuously enlarge the outer radius of the cam disk support shaft, the bores of the cam disks being matched to the enlarged portion of the outer radius of the cam disk support shaft, so that by relative rotation of the cam support shaft and the cam disks and also the drive wheel the components are firmly joined and the camshaft is formed.

14 Claims, 5 Drawing Sheets

CAMSHAFT AND METHOD FOR PRODUCING A CAMSHAFT

This is a Continuation-In-Part Application of International Application PCT/EP2005/002339 filed Mar. 5, 2005 and claiming the priority of German Application 10 2004 011 815.9 filed Mar. 11, 2004.

BACKGROUND OF THE INVENTION

The invention relates to a camshaft for an internal combustion engine having a cam disk support shaft, to which a plurality of cam disks and one drive wheel are attached, via matching outer cam disk support shaft and cam disk opening profiles. The invention also relates to a method for producing a camshaft, in which method a plurality of cam disks and at least one drive wheel are attached to a cam disk support shaft.

Camshafts of the type, which comprise a plurality of individual parts and are used in internal combustion engines to control the valve opening times, are called constructed camshafts.

DE 42 09 153 C2 discloses a profile for a detachable shaft/hub connection, in which profile both the shaft and the hub comprise more than one curved wedge corresponding to a logarithmic spiral function and have a micro-toothing at the circumference. Such a multi-wedge profile has the disadvantage that there are circumferential regions which are not in contact and the radial profile extent is very small. The gradient of the logarithmic spirals is selected such that the shaft/hub connection is maintained substantially by means of non-positive locking.

In the camshaft described in DE 41 21 951 C1, the cam disks are produced by means of forging and can have an opening whose shape deviates from that of a circle. The shaft profile is shaped by means of rolling and has elevations and depressions which lead to circumferential and therefore circular cross-sectional variations on the shaft. Circumferential channels are formed in the shaft by means of rolling, said channels pushing out circumferential beads as a result of material displacement. The radially elevated portions extend annularly in the axial direction of the cam disk support shaft and are oversized in the radial direction in relation to the openings in the cam disks. During joining, the cam disks are individually pressed, in a similar way to a longitudinal interference fit, onto the support shaft in the axial direction, between two profiling operations in each case. In addition, the cam disks must have a chamfer at the edge, so that they do not twist as they are pressed onto the shaft. A disadvantage of this is that when a cam disk is pressed onto the support shaft, the shaft beads are partially smoothed and lose their oversize because of wear during joining. For this reason, in the described method, the cam disks are reamed, in an expensive fashion, in order to form a rotationally symmetrical micro-toothing.

The so-called internal high-pressure forming method, which can result in considerable cost savings, is often used in the production of other camshafts. The main advantage of the constructed camshaft produced by internal high-pressure forming over conventional solutions is a reduction in material costs. A relatively cheap, unprocessed steel material is used for the actual shaft, which is also called a cam disk support tube, and high-grade, alloyed, hardenable ball bearing steel is used for the cam disks. The support tube is upset, in order to increase the wall thickness, at that end at which the camshaft drive wheel is attached. The support tube is machined at the ends and at its circumference. The cam disks are forged, are pre-machined by cutting and are heat treated. After joining by means of internal high-pressure forming, the cam shapes and the camshaft bearing seats are ground on the assembled camshaft in different work piece fixture mounting positions.

However, camshafts for commercial vehicles must be capable of transmitting significantly greater torques than camshafts for passenger automobiles. The reasons for this are the higher gas exchange valve operating forces as a result of the greater piston displacement volumes. In addition, commercial vehicle engines are sometimes used, in special applications, for driving auxiliary units by way of the camshaft, for example in agricultural machines for driving hydraulic units by way of the camshaft.

In this context, the internal high pressure forming process is considerably restricted: it necessitates a hollow camshaft, or a tube for holding the cam disks, whose wall thickness additionally cannot be so large, so that the required expansion pressures can still be provided. As a result, the construction material for the camshaft tube is generally relatively expensive. In the relevant diameter ranges, seamlessly drawn or longitudinally welded tubes which may be used are more expensive than the rolled solid round material. Here, it must be taken into consideration that, for reasons of strength, the tube must be deformed at one end, and that a closure cover is required at one end in order to prevent oil from flowing out. A second aspect is that the tube has a lower resistance with regard to torsional and bending loads than the solid shaft, requiring, under some circumstances, and for comparable loading, that the shaft tube is of greater diameter.

The internal high pressure forming technique also requires a relatively high operating system investment. On the one hand, this is because of the hydraulic unit required for generating the required pressure, and on the other hand, there are safety-related requirements which influence the system costs on account of the very high operating pressures of 2500 to 3000 bar. A further negative cost aspect of the internal high pressure forming method is the day-to-day operating costs. The seals which seal off the internal high pressure forming lance from the camshaft tube are subject to considerable wear and must be exchanged regularly, which in turn limits the degree of equipment efficiency of the system. As a result of the non-positive transmission of the operating forces, it is also only possible to a limited extent for the internal high pressure forming technique to be an operationally reliable non-positive shaft/hub connection for commercial vehicle camshafts.

In order for it to be at all possible, to join the cam disks to the support tube, in known constructed camshafts, the respective cam disk bore must be pre-machined. This can only be done in the unhardened state of the shaft. In order to provide the cam disks with their final hardness, it is necessary to heat them, normally by induction heating, and subsequently to quench them in a water bath or oil bath.

One method for producing a constructed camshaft using internal high pressure forming, and a constructed camshaft made from a shaft tube and elements which are pushed onto the tube, is known from EP 0 265 663 B2. The shaft is expanded hydraulically, resulting in the shaft/hub connection being generated by means of non-positive interlocking.

In accordance with EP 0 328 009 B1 or EP 0 328 010 B1, a tube can also be expanded by means of internal high pressure after assembly of the shaft, whereby the cam disks are fastened to two tubes, which are placed over one another, in order to increase strength. Torque is transmitted in a non-positively locking manner. This solution, however, is relatively expensive because of the plurality of components required.

EP 0 374 389 B1 discloses a method for pre-treating components of an constructed camshaft. The document describes heat treatment measures for a tube which are intended to facilitate expansion of the tube as a result of internal high pressure shaping or to provide for the bearing location a greater degree of hardness.

In the constructed shaft according to EP 0 374 394 B1, the cam disk support tube is pre-formed with different cross sections, so that during the subsequent expansion by means of internal high pressure forming, only those tube sections which hold the cam disks are plastically deformed. The tube sections between the individual cam disks are only expanded elastically.

In the method described in EP 0 313 565 B1 for producing a camshaft, tubes are used as supports for the cam disks. The cam disks are shaped in a die together with the support tube starting from a circular cross section, so that a constructed camshaft is produced. It is a disadvantage that hardened cam disks cannot be shaped at room temperature, since the cam disks would otherwise break apart or at least cracks could form in them. A separate heat treatment process is therefore required in the method described in this document.

One method for producing a constructed camshaft using internal high pressure deforming, and a constructed camshaft comprising a shaft tube and elements which are pushed onto the shaft tube, is described in EP 0 265 663 A1. The cam disks can have inner profiles in their openings in order to obtain positive locking in addition to the non-positive locking, the tube which forms the shaft being plastically deformed while the cam disks are elastically expanded.

A constructed camshaft comprising a hollow shaft which is produced by means of internal high pressure deforming is known from EP 0 516 946 B1. The cam disks which are fastened to the shaft have a circular cross-section and a groove which extends in the axial direction. The groove is at least partially filled with the shaft material as a result of plastic deformation of the shaft during the internal high pressure deforming process, resulting in a positively locking rotational connection.

A method for producing a single-piece hollow camshaft is described in EP 0 730 705 B1, in which method a tube is expanded in a die by means of internal high pressure deforming in such a way that a hollow camshaft is produced. This has the advantage that no separate cam disks need be produced. On the other hand, it is a disadvantage that heat treatment of the camshaft is necessary. In addition, the wall thickness of the camshaft is reduced to a particularly high degree in the regions of the cam peaks, as a result of which it is barely possible to meet the strength requirements for a commercial vehicle camshaft using this technology.

A camshaft and a method for producing the same are described also in EP 0 970 293 B1. Here, thin cam disks are punched out of a metal sheet or out of a sheet metal strip. A plurality of thin cam disks is assembled on top of one another or adjacent to one another to form sheet metal stacks. Accordingly, a cam disk is composed of a plurality of parts which are ultimately joined to a tube by means of internal high pressure deforming of the shaft. On the circumference, the cam disks can have a toothing or a notch-like profile which serves to provide for rotational locking.

The constructed camshaft known from EP 0 856 642 A1 is based on a longitudinal interference fit, the joining partners being coated at the joining points. The coating can be a phosphate layer or else adhesive. A profiling option which is not specifically described is also claimed.

EP 0 839 990 B1 proceeds from a cam disk support shaft produced by means of casting. This support shaft can be profiled at the points where the cam disks are fastened. The rotationally-non-symmetrical profile may be formed integrally during casting for the purpose of balancing and therefore serves to provide for a better mass distribution of the shaft. The cold forming of cast-iron components however is generally problematic because of their brittleness.

In the very similar method according to DE 37 17 190 C2, the profiling is carried out by means of rolling rods which have longitudinal grooves. The profile of a groove in the rolling die substantially follows the movement direction of the rolling rod, which has the same profile in every cross section perpendicular to the movement direction. In the case of a thread-like, bead-shaped enlarged portion of the cam disk support shaft, if such an enlarged portion is provided, the depression does not extend exactly in the movement direction of the rolling rod, but is inclined by a thread gradient angle. The cross sections of a rolling rod are then not entirely equal over the length. When viewed from the side, however, every rolling rod appears as being rectangular. The longitudinally extending straight delimiting lines of the side view of a rolling rod are parallel to the movement direction. The purpose of the polygon claimed here as an example of the support shaft profile, whose shape deviates from that of a circle, is intended to approximate a circle.

The constructed camshaft described in DE 195 20 306 C1 involves an indirect positively locking connection. A corrugated clamping sleeve is used which engages a rotationally symmetrical shaft toothing and an inner toothing, which is likewise rotationally symmetrically formed at the cam disk opening. A disadvantage of this, however, is the need for handling the clamping sleeve as a separate component.

EP 0 580 200 B1 relates to the cam disk being designed so as to be of a lightweight construction, for which purpose said cam disk is produced from a thin metal sheet. This design, however, is hardly capable of meeting the strength requirements of a camshaft.

The formation of an axial transition zone between two closely adjacent raised cam portions is known from EP 0 459 466 B1. This is significant only for single-piece camshafts but not for constructed camshafts.

In the method proposed in EP 0 650 550 B1, a cam disk support tube is expanded mechanically by means of a mandrel which is pushed or pulled through a disk support tube. It is additionally required that the cam disk support tube has different wall thicknesses before joining. The joining face can have recesses, pockets or a toothing. If a toothing is provided for the profile of the joining face, such toothing is to be formed on both joining partners, that is to say on the camshaft and on the cam disks.

In the very similar method according to EP 0 663 248 B1, wall thicknesses which are different in terms of shaping are formed in a tube by means of a stepped mandrel.

A constructed crankshaft and a method for producing the same are described in DE 100 61 042 C2. A conical curved wedge is used herein. A maximum of two crank webs can be joined to a crankpin journal by means of rotation relative to one another. The joining faces must be machined by cutting on account of the stringent tolerance requirements. During joining, the shaft is substantially elastically deformed, with the connection being releasable.

All the methods described are therefore incapable of meeting the demands on a highly-loaded camshaft. There is no solution which can be implemented in a simple and cost-effective manner.

It is therefore the principal object of the present invention to produce a relatively inexpensive camshaft which fulfills the high strength requirements, and a method for producing such a camshaft which method can be carried out with relatively little outlay and therefore at low costs.

SUMMARY OF THE INVENTION

In a camshaft for an internal combustion engine having a cam disk support shaft, to which a plurality of cam disks and a drive wheel are attached, the outer radius of the cam disk support shaft varies continuously in those sections in which the cam disks are attached. The cam disks have bores whose inner radius varies continuously and the cam disk support shaft is alternately provided with elevations and depressions in those sections in which the cam disks are attached, said elevations and depressions forming a wedge-shaped curve profile about the circumference of the mounting section of the cam disk support shaft The elevations continuously enlarge the outer radius of the cam disk support shaft, the bores of the cam disks being matched to the enlarged portion of the outer radius of the cam disk support shaft, so that by relative rotation of the cam disk support shaft and the cam disks and also the drive wheel, the camshaft is formed.

In contrast to known solutions, this does not involve rotationally symmetrical or circumferential channels or beads, but rather a non-circular profile at each cam disk fastening point. The cam disks are connected to the cam disk support shaft by means of the continuous enlargement of the radius of the cam disk support shaft whereby a transverse interference fit is formed in which no special coating of the contact faces is required. This results in the cam disks being fixed in both the radial and axial directions of the cam disk support shaft without additional material or the requirement of further joining steps.

If only one wedge-shaped curve profile is provided about the circumference of the cam disk support shaft and the bore of the cam disk, on the one hand an increased diameter difference and therefore increased strength of the connection for the same gradient of the wedge-shaped curve profile is provided. On the other hand, the loss zone which is inevitably present, that is to say that region in which the cam disks are not in contact with the cam disk support shaft, is smaller, so that the cross section of the connection is better utilized irrespective of the joining play which is initially present.

The strength of the connection between the cam disk support shaft and the cam disks provided by the present invention is markedly greater than in solutions according to the prior art. In addition, it is possible in the case of the camshaft according to the invention to connect non-machined cam disks to the cam disk support shaft, which constitutes a considerable time saving and therefore cost saving.

If, in an advantageous refinement of the invention, the inner profile of the bore of the cam disks is formed as a mirror image of the inner profile of the bore of the drive wheel, the cam disks and the at least one drive wheel can be attached to the cam disk support shaft in a particularly simple way in that the drive wheel is rotated while the cam disks are held in a rigid position. The device required for this purpose can be of particularly simple construction and the described method is very simple to control.

In addition, this approach leads to the rotational direction of the camshaft under operating conditions of the internal combustion engine being directly linked to the profile geometry, resulting in the strength of the camshaft according to the invention being further increased. If all the cam disks are joined at the same time as the camshaft drive wheel, the expensive reaming process during the machining of the cam disks is also not required, since any deviations in mass which may be present are compensated for.

A particularly high strength of the camshaft according to the invention is achieved if the cam disk support shaft is a solid shaft. Alternatively, it is however also possible that the cam disk support shaft is a hollow shaft. Then, however, a mandrel should be inserted into the hollow shaft during the processing of the cam disk support shaft.

A particularly simple deformation of the cam disk support shaft is possible if the depth of the depressions increases continuously with the enlargement of the elevations.

The method according to the invention can accommodate manufacturing tolerances of such a size that the soft machining of the bore of the cam disks is not necessary and a cost saving can therefore be obtained. In addition, with the present invention, only the outer profile of the cam disk support shaft needs to be shaped, and not also the cam disks at the same time. This has the advantage that the contacting joining face is larger and that no other auxiliary means, for example preparatory shrink-fitting of the cam disks onto the cam disk support shaft or subsequent expansion of the cam disk support shaft or even soldering of the joining faces, is required.

According to the invention, the cam disks are pushed onto the cam disk support shaft with play and are fixed by means of a rotational movement. As a result of this, and as a result of the geometry according to the invention, the question of centering the joining partners is advantageously virtually irrelevant, resulting in low costs for the method according to the invention.

In an advantageous refinement of the method according to the invention, the cam disk support shaft is plastically deformed when the cam disks and the at least one drive wheel are attached to the cam disk support shaft, the cam disks and the at least one drive wheel being elastically expanded. After the formation of the depressions and elevations in the shaft profile in order to form a curved wedge profile by the resulting envelope around the expanded portions, the profile of the cam disk support shaft can be partially smoothed again during joining as a result of the plastic deformation of the cam disk support shaft. The connection between the cam disk support shaft and the cam disks is in this way maintained substantially by means of the plastic deformation of the shaft during joining and by means of the elastic expansion of the hub. This is also advantageous if the individual cam disks have certain dimensional discrepancies, since the latter can be compensated for by the plastic deformation.

The strength of the camshaft is further increased if the elevations and depressions are formed in the cam disk support shaft by means of cold forming. Special heat treatment or another particular measure for increasing strength is not required as a result.

In this context, it can be provided that the elevations and depressions are formed in the cam disk support shaft by means of two rod-shaped rolling dies which are moveable relative to one another. It is possible to obtain considerable cost savings over conventional methods such as hobbing or generating gear structures by cutting depending on the requirements imposed on the elevations and depressions. In comparison with a toothing produced by cutting, the toothing, which is formed at room temperature by means of shaping is advantageously of a higher strength.

In an advantageous refinement of the method according to the invention, the profile of the cam disk bore can be generated with the required final quality by means of forging, leading to a further simplification of the production of the camshaft according to the invention.

The invention will become more readily apparent from the following description of exemplary embodiments of the invention on the basis of the drawing:

DETAILED DESCRIPTION OF THE INVENTION

Figure 1:
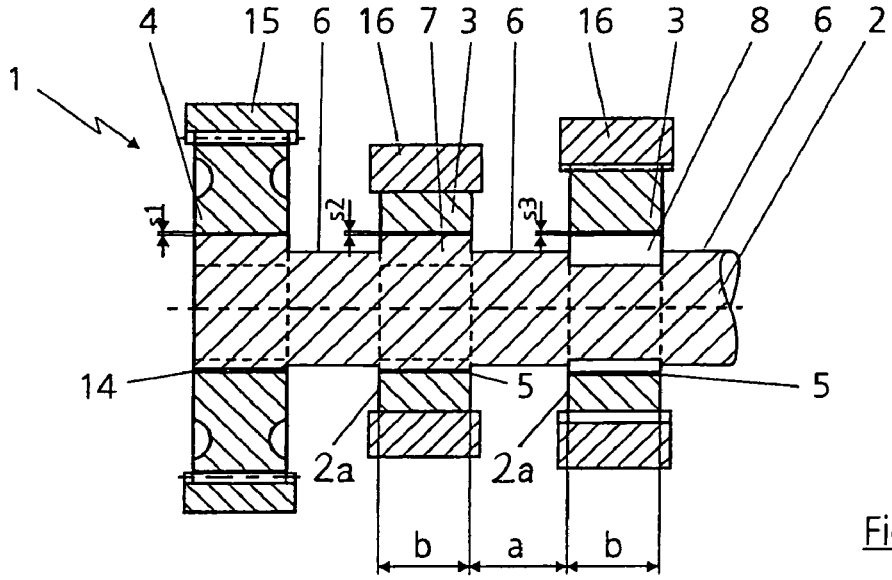
FIG. 1 is a side view of the camshaft according to the invention.
Figure 2:
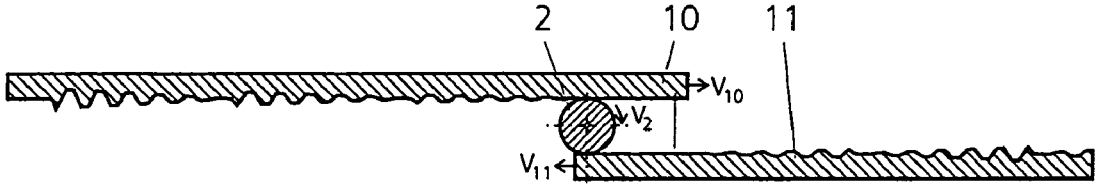
FIG. 2 shows a first method of forming elevations and depressions in the cam disk support shaft, in a first state.
Figure 3:
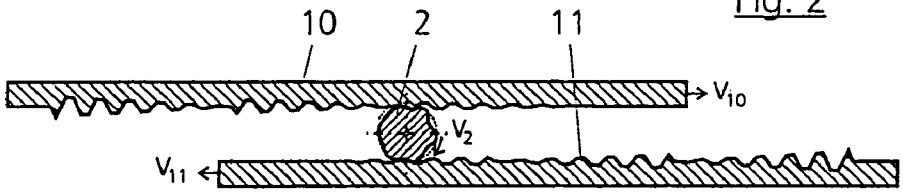
FIG. 3 shows the method of FIG. 2 in a second state.
Figure 4:
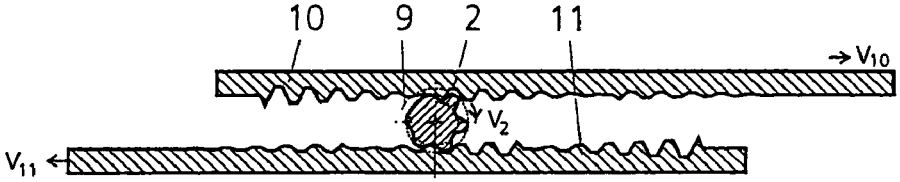
FIG. 4 shows the method of FIG. 2 in a third state.
Figure 5:
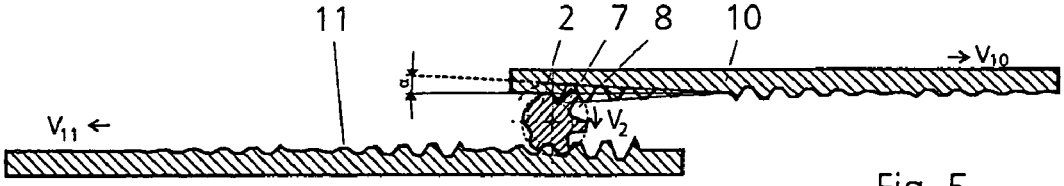
FIG. 5 shows the method of FIG. 2 in a fourth state.

FIG. 1 shows a composition camshaft 1 comprising a cam disk support shaft 2 on which, in the assembled state, a plurality of cam disks 3 and a camshaft drive wheel 4 are mounted in a rotationally fixed manner at respective sections 2*a* of the cam disk support shaft 2. The camshaft 1 serves, in a known way, to control the valve opening times in an internal combustion engine (not illustrated). The cam disks 3, the number of which depends on the internal combustion engine, each have a bore 5 for attaching the cam disks 3 to the sections 2*a* of the cam disk support shaft 2, the cam disks 3 generally being offset relative to one another by a certain angle.

The camshaft 1 additionally has a plurality of bearing locations 6 at which it is supported for example in a crankcase of the internal combustion engine. FIG. 1 illustrates the camshaft 1 in its unassembled state, the cam disks 3 and the drive wheel 4 each having play s1, s2 and s3 relative to the cam disk support shaft 2. It can be seen that the axial spacing a between two adjacent cam disks 3 is greater than the width b of a cam disk 3.

A rod material composed of steel is preferably used as a starting material for the cam disk support shaft 2, it being possible for said rod material, for example, to be hot-rolled. The demands on the material of the cam disk support shaft 2 are a certain cold deformability and toughness. A special heat treatment by means of hardening and tempering, or a particularly high resistance to wear, is not necessary. Drawn rod materials having a circular starting cross section can however also be used as semi-finished parts for the cam disk support shaft 2. Hollow bodies such as tubes can like-wise be used, which would result in the overall camshaft 1 maintaining a relatively low mass, and no deep bore has to be drilled for supplying lubricant to the various lubrication points. In this case, however, a mandrel is to be inserted into the hollow shaft for the purpose of processing of the cam disk support shaft 2, as is described later.

As described in the following with reference to FIGS. 2 to 5, a tooth-like profile having a plurality of local elevations 7 and a corresponding number of local depressions 8 are formed in the cam disk support shaft 2, said elevations 7 and depressions 8 being arranged alternately to one another. As a result of the targeted formation of the depressions 8 in the surface of the cam disk support shaft 2, a wedge-shaped curve profile 9 is generated as an envelope of all the elevations 7 as a result of material displacement, the outer contour of the sections 2*a* being formed similarly to a toothing having discontinuous support faces. The depressions 8 formed in the shaft do not constitute a micro-toothing to increase the non-positive locking. They can at best be understood as representing a macro-toothing.

Two rod-shaped rolling dies are provided for the purpose of processing the cam disk support shaft 2, said rod-shaped rolling dies being called below rolling rods 10 and 11 for the sake of simplicity. They are provided, at their sides which face toward one another respectively, with profiles forming alternating cavities and projections for forming the elevations 7 and the depressions 8 in the cam disk support shaft 2 by means of cold forming during a relative movement of the two rolling rods 10 and 11. For the purpose of processing, the cam disk support shaft 2 is preferably clamped between two spikes (not illustrated), whereupon the rolling rods 10 and 11 are set in motion synchronously and at the same speed in the direction of the arrows denoted by $V_{10}$ and $V_{11}$. The cam disk support shaft 2 is set in rotation according to the arrow $V_2$ as a result and moves about its own axis a number of times during processing. The length of the two rolling rods 10 and 11 accordingly corresponds to a multiple of the diameter, or of the circumference, of the cam disk support shaft 2. During the translatory movement of the rolling rods 10 and 11, the latter exert a radial pressure on the cam disk support shaft 2, and shape the latter. It can be seen from FIGS. 2 to 5 that the profile depths of the rolling rods 10 and 11 increase over the length of said rolling rods 10 and 11, resulting in the required change of the shaping forces.

The entire rolling process illustrated in FIGS. 2 to 5 can be finished in a few seconds, after which the rolling rods 10 and 11 move back into their original position. The cam disk support shaft 2 can then be pushed along its longitudinal axis to the next section 2*a* which is to be shaped, whereupon the formation of the elevations 7 and the depressions 8 is repeated in order to form the wedge-shaped curve profile 9.

During shaping, each cavity of the profile of the rolling rods 10 and 11, said cavity extending transversely with respect to the movement direction of the rolling rods 10 and 11, forms an elevation 7 on the cam disk support shaft 2, and each projection, said projection likewise running transversely with respect to the movement direction of the rolling rods 10 and 11, forms a depression 8 on the cam disk support shaft 2. It is clear from the illustrated embodiment of the profile of the rolling rods 10 and 11 that the elevations 7 continuously increase the radius of the cam disk support shaft 2, since every successive cavity of the profile is deeper than the preceding one. In the present case, this also means that the higher the projections of the profile of the rolling rods 10 and 11, the deeper the subsequent cavity is, which facilitates the material displacement during the shaping process.

In the present case, the wedge-shaped curve profile 9 which is generated during shaping, that is to say the envelope of the elevations 7, is embodied as an Archimedes or logarithmic spiral. In addition to an Archimedes or logarithmic spiral, higher-order mathematical functions, for example a Fermat's spiral, Galilean spiral or hyperbolic spiral, a sinus spiral, a lemniscate, a quadratrix or others, could also be considered for the wedge-shaped curve profile 9, the function itself not being of particular significance. It is necessary only that the wedge-shaped curve profile 9 is an opening function which widens in polar coordinates with the rotational angle, and has a shape which deviates from that of a circle. The center of said function need not strictly coincide with the rotational axis of the cam disk support shaft 2, so that eccentric spirals are also possible.

The geometric relationships are simplified if an Archimedes spiral having a gradient of tan $\alpha$ is selected for the envelope for the connection of the cam disks 3 to the cam disk support shaft 2. In this case, the lowest points of all the cavities of the profile of the rolling rods 10 and 11 are situated on a straight line which encloses the gradient angle $\alpha$ with the movement directions $v_{10}$ and $v_{11}$ of the rolling rods 10 and 11. If appropriate, however, it can also be provided that the lowest points of all the cavities of the profile of the rolling rods 10 and 11 are situated on a curved path. This also applies to the highest points of the projections of the profile of the rolling rods 10 and 11.

Two rolling rods 10 and 11 are provided in each case for processing a projection, in order to support the cam disk support shaft 2 during the rolling process and to dissipate the rolling forces. The rolling rods 10 and 11 are preferably of geometrically identical design and are arranged with an offset relative to one another which corresponds to half of the mean circumference of the cam disk support shaft 2. The rolling rods 10 and 11 can be optimized such that the required shaping work for forming the wedge-shaped curve profile 9 in the cam disk support shaft 2 is distributed evenly between both the rolling rods 10 and 11. The cam disk support shaft 2 can be driven indirectly by the rolling rods 10 and 11 by means of their rolling movement. However, it is also possible to drive the cam disk support shaft 2 during rolling by means of an individually controlled rotary drive, for which purpose the cam disk support shaft 2 must be clamped in a suitable holding device, for example a jaw chuck or a collet chuck.

The rolling rods 10 and 11 are preferably composed of hardened steel and are preferably of the same width b as the cam disks 3. The depressions can be formed in the rolling rods 10 and 11 by means of known machining techniques including, for example, surface grinding and deep grinding using a correspondingly profiled grinding wheel. The grinding wheel profile can in turn be formed by means of, for example, CNC truing by means of diamond tiles in the grinding wheel.

As indicated above, a separate shaping process is provided for each section 2*a* at which a cam disk 3 is fastened to the cam disk support shaft 2, said shaping processes being carried out one after the other, for which purpose the cam disk support shaft 2 remains clamped. Between the shaping processes, however, the cam disk support shaft 2 must be repositioned in a rotational sense corresponding to the required rotational angle offset of the cam disks 3, and if appropriate, must be displaced axially, together with the rotary drive, corresponding to the distance a+b of the cam disks 3 which are adjacent to one another.

Figure 6:
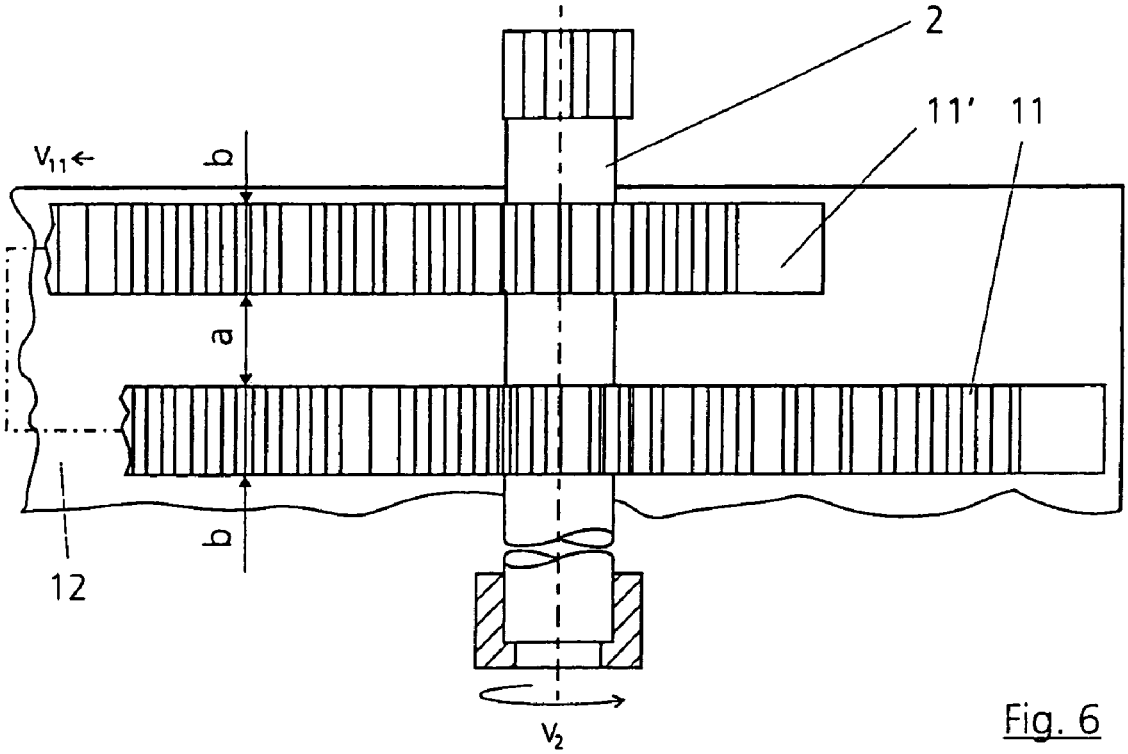
FIG. 6 shows another method of forming elevations and depression in a cam disk support shaft.

As is illustrated in FIG. 6, it is however also possible to form all the sections 2*a* for the cam disks 3 in one single rolling step. For this purpose, two rolling rods 10, 10' and 11, 11', or a number of rolling rod pairs 10 and 11, 10' and 11', . . . corresponding to the number of cam disks 3, must be provided for each section 2*a* of the cam disk support shaft 2 with a spacing a, as a result of which the productivity of the rolling procedure is significantly increased. Here, all the lower rolling rods 11 and 11' are fastened to a lower slide 12 which is displaceable transversely with respect to the rotational axis of the cam disk support shaft 2, as a result of which the lower rolling rods 11 and 11' can simultaneously be moved synchronously to the rotation of the cam disk support shaft 2. An upper slide, which holds all the upper rolling rods 10, 10', . . . and runs in the opposite direction to the lower slide 12, is not illustrated.

Figure 7:
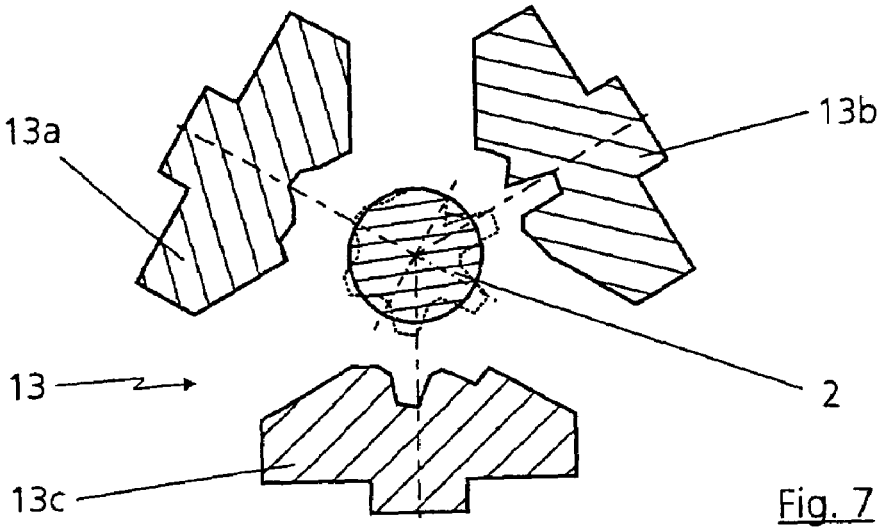
FIG. 7 shows a embodiment (punching) of forming elevations and depressions in the cam disk support shaft as per the method according to the invention, in a first state.
Figure 8:
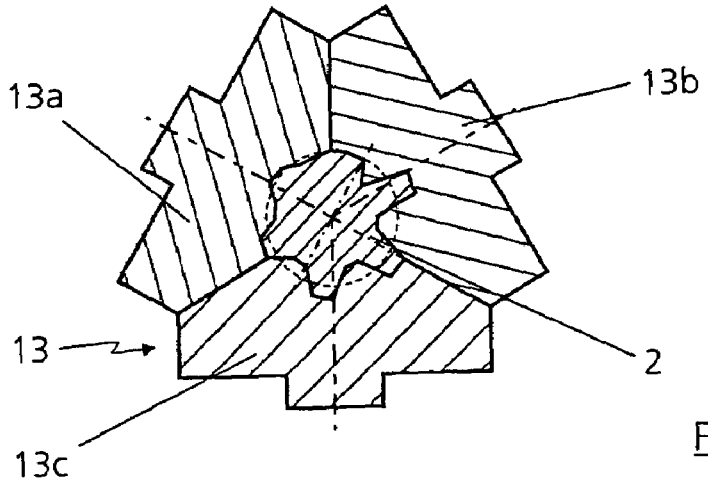
FIG. 8 shows the method of FIG. 7 in a second state.
Figure 9:
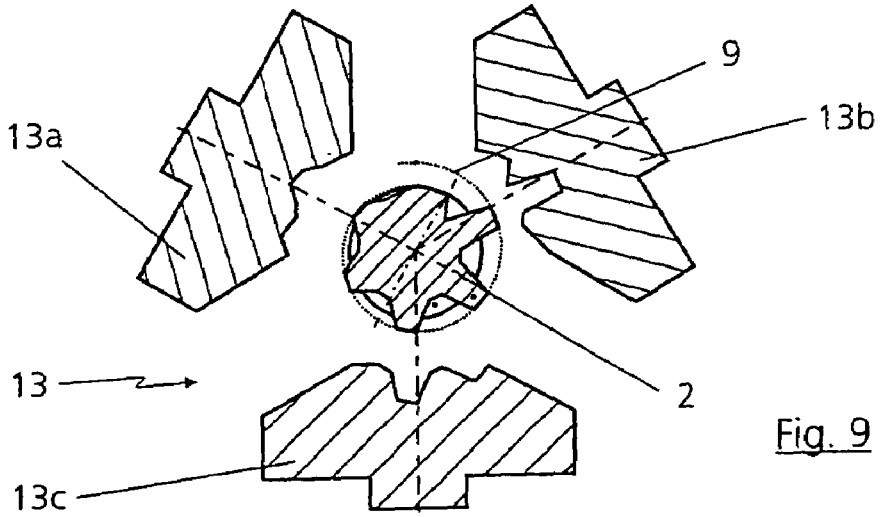
FIG. 9 shows the method of FIG. 7 in a third state.

FIGS. 7, 8 and 9 illustrate an alternative shaping process for forming the wedge-shaped curve profile 9 in the sections 2*a* of the cam disk support shaft 2. For this purpose, a die 13 is provided which in the present case has 3 die parts 13*a*, 13*b* and 13*c* which are moveable relative to one another and have a respective profiling which forms the elevations 7 and the depressions 8. In the die 13, the cam disk support shaft 2 is shaped under rising or pulsed pressure loading, for example by means of swaging, by means of the illustrated closing and opening movement of the die parts 13*a*, 13*b* and 13*c*. The die parts 13*a*, 13*b* and 13*c* are each of the same width b as the cam disks 3. During processing, the die parts 13*a*, 13*b* and 13*c* perform a radial movement relative to the cam disk support shaft 2, it being possible for the force for shaping the material to be introduced hydraulically, pneumatically or electromechanically by means of a known, linearly guided actuator.

In a similar way to the previously described rolling profiling, the individual profile cross sections of the cam disk support shaft 2, that is to say the sections 2*a* which are to be shaped, are formed successively, for which purpose the cam disk support shaft 2 is placed into a new rotational angle position before shaping in each case. It is of course alternatively possible to arrange a plurality of dies 13 in the longitudinal direction of the cam disk support shaft 2 and to provide all the sections 2*a* of the cam disk support shaft 2 with the wedge-shaped curve profile 9 at the same time.

In an embodiment which is not illustrated, it would also be possible to cast the cam disk support shaft 2, for which purpose the corresponding casting mold could be formed similarly to the die 13, at least at the sections 2*a*.

The production of the cam disks 3 is not illustrated in the figures. Said cam disks 3 can, for example, be forged, the forged contour expediently approximating very closely to the final contour of the cam disks 3. It is then necessary only to machine the outer functional faces of the cam disks 3 for valve control by cutting. This also applies to the bearing points 6 of the cam disk support shaft 2 after the camshaft 1 is assembled, as is described in the following. It is also possible to produce the cam disks 3 by means of casting or sintering. As can be seen in FIGS. 10 to 17, the inner profile of the bores 5 of the cam disks 3 is matched to the elevations 7 and therefore to the enlargement of the outer radius of the cam disk support shaft 2 and therefore to the wedge-shaped curve profile 9.

The manufacturing technique described with reference to FIGS. 2 to 6 and 7 to 9 for forming the sections 2*a* of the cam disk support shaft 2, for holding the cam disks 3, by means of shaping can also be used in an identical way for the shaft profile for holding a bore 14 of the drive wheel 4. For reasons which are explained in the following, the only difference is that the winding or opening orientation of the wedge-shaped curve profile 9 of the shaft profile for holding the drive wheel 4 is mirror-inverted with respect to the wedge-shaped curve profiles 9 for holding the cam disks 3. For assembly reasons, the gradient of the wedge-shaped curve profile 9 of the shaft profile for holding the drive wheel 4 is generally also greater than that for holding the cam disks 3.

The bore 14 of the drive wheel 4 likewise substantially corresponds to the bore 5 of the cam disks 3. However, the inner profile of the bore 5 of the cam disks 3 is mirror-inverted with respect to the inner profile of the bore 14 of the drive wheel 4.

Figure 10:
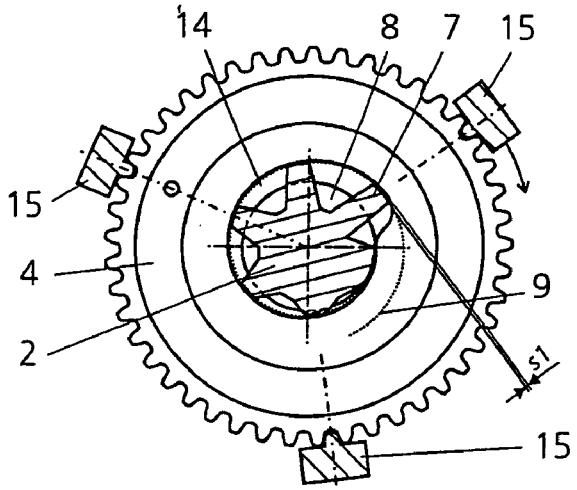
FIG. 10 shows the attachment of the drive wheel to the cam disk support shaft as per the method according to the invention, in a first state.
Figure 11:
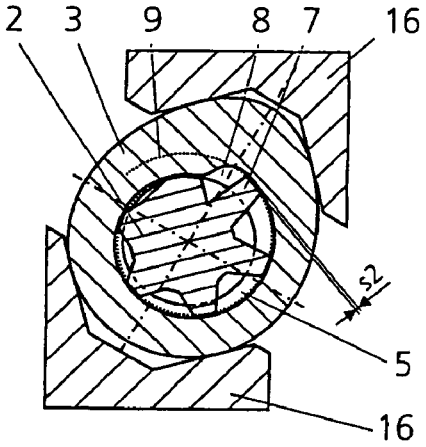
FIG. 11 shows the attachment of a cam disk to the cam disk support shaft as per the method according to the invention, in a first state.
Figure 12:
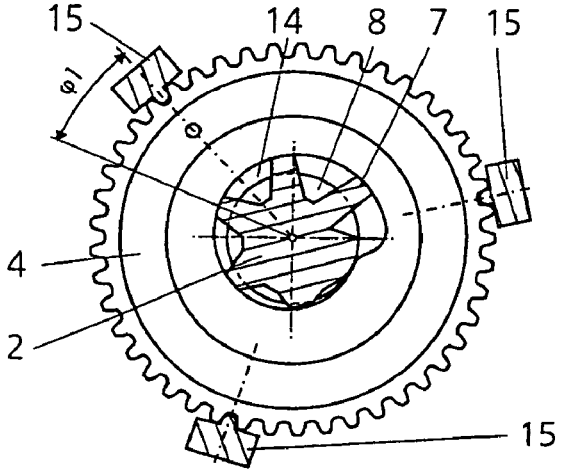
FIG. 12 shows the method of FIG. 10 in a second state.
Figure 13:
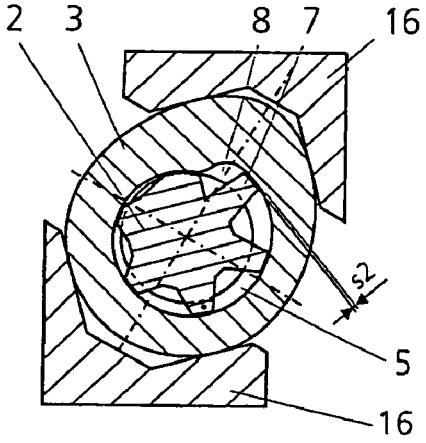
FIG. 13 shows the method of FIG. 11 in a second state.

FIGS. 10 and 11, 12 and 13, 14 and 15 and also 16 and 17, in each case in pairs, show the procedure of a possible embodiment of attaching the cam disks 3 and the drive wheel 4 to the cam disk support shaft 2. FIG. 10 illustrates that the drive wheel 4 is clamped by means of three clamping elements 15. The clamping elements 15 are part of a rotary device, not illustrated in its entirety, which has a rotary drive which is preferably controlled in a closed-loop fashion with monitoring of the angular position of the clamping elements 15 and therefore of the drive wheel 4. In contrast, the cam disks 3, as can be seen from FIG. 11, are rotationally fixedly clamped, and are fixed in position, by means of two clamping elements 16. If, as is illustrated in FIGS. 12 and 13, the drive wheel 4 is now rotated relative to the fixed cam disks 3 about the angle $\phi 1$, the initial joining play s1 between the drive wheel 4 and the cam disk support shaft 2 is reduced to 0. The cam disk support shaft 2 is not, however, rotated relative to the cam disks 3.

Figure 14:
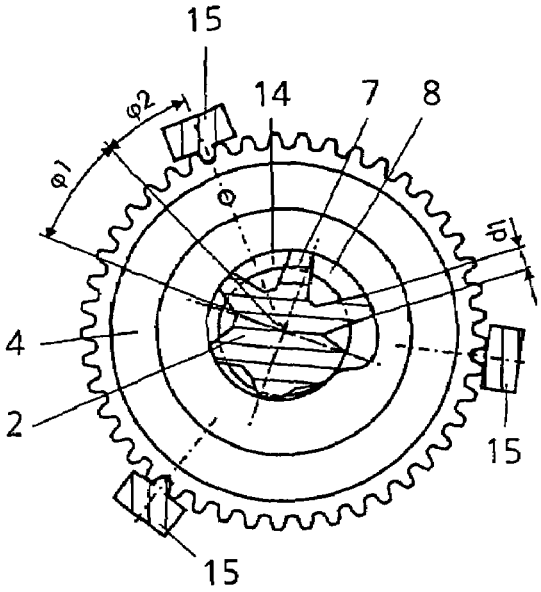
FIG. 14 shows the method of FIG. 10 in a third state.
Figure 15:
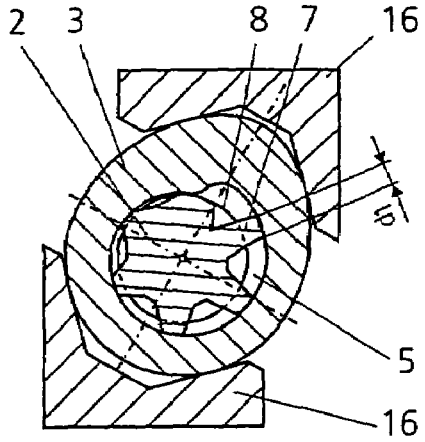
FIG. 15 shows the method of FIG. 11 in a third state.

During the further rotation of the drive wheel 4 relative to the fixed cam disks 3 about the angle $\phi 2$, as is illustrated in FIGS. 14 and 15, the cam disk support shaft 2 is likewise rotated about the angle $\phi 2$ as a result of being driven in a positively locking fashion. As a result of the cam disk support shaft 2 being driven in rotation relative to the cam disks 3 about the angle $\phi 2$ in this way, the initial joining play s2 is likewise reduced to 0, as can be seen in FIG. 15. As a result of the dimensional tolerances, the initial joining play s2 at each cam disk 3 is reduced at a different instant and at a different rotational angle position of the drive wheel 4.

Figure 16:
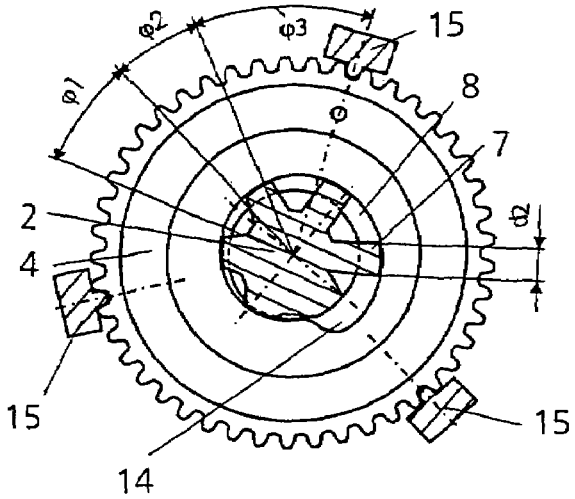
FIG. 16 shows the method of FIG. 10 in a fourth state.
Figure 17:
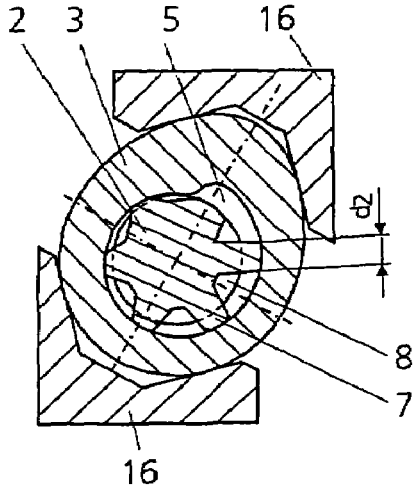
FIG. 17 shows the method of FIG. 11 in a fourth state.

The plastic deformability of the cam disk support shaft 2, and in particular of its wedge-shaped curve profile 9, is utilized during the further rotation of the drive wheel 4 about the angle $\phi 3$, as illustrated in FIG. 16. As a result of the torque which is required to rotate the drive wheel 4 about the angle $\phi 3$, and acts on the cam disk support shaft 2 via the rotary device of the drive wheel 4, reaction forces are generated which act, inter alia, in the radial direction. Said reaction forces act from the cam disks 3 on the cam disk support shaft 2, as a result of which the width of the elevations 7 of the wedge-shaped curve profile 9 is deformed from an initial width d1, as illustrated in FIG. 15, to a width d2, as illustrated in FIG. 17. This results in compression setting of all the wedge-shaped curve profiles 9 of the cam disk support shaft 2, the material being displaced into the depressions 8. While the cam disk support shaft 2 is plastically deformed at the joining faces within the regions enclosed by the bores 5 of the cam disks 3, the joining forces bring about a substantially elastic expansion of the cam disks 3. This generates an interference fit between each cam disk 3 and the sections 2*a* of the cam disk support shaft 2.

At the same time, the torque which is introduced into the cam disk support shaft 2 by the drive wheel 4 during joining causes plastic deformation of the shaft profile which is enclosed by the drive wheel 4. Here, under the radial forming pressure, the initial width of the elevations d1 as per FIG. 14 is likewise increased, as is the case for the cam disks 3, to the width d2 according to FIG. 16. In a similar way to the expansion of the cam disks 3, the bore 14 of the drive wheel 4 is also elastically expanded by means of the assembly torque. As already mentioned, the bore 14 of the drive wheel 4 generally has a larger radial extent than the bores 5 of the cam disks 3. With corresponding design of the geometry parameters, it can be achieved that all the non-circular shaft profiles are deformed simultaneously during the assembly rotational movement about the angle $\phi 3$. With suitable measures, this is intended to prevent the drive wheel 4 slipping over the cam disk support shaft 2 under the action of the joining forces during joining.

After the predefined rotational angle $\phi 3$ has been reached, the rotary controller of the rotary device ends the rotational movement of the drive wheel 4, and the assembly torque falls to zero. The cam disks 3 and the drive wheel 4 spring back in the radial direction and their elastic expansion is partially reduced again. Said cam disks 3 and drive wheel 4 exert a permanent radial pressure on the plastically deformed cam disk support shaft 2, said radial pressure preventing the individual joint connections of the cam disks 3 against the cam disk support shaft 2 and of the drive wheel 4 against the cam disk support shaft 2 from loosening. At the same time, the cam disks 3 and the drive wheel 4 are prevented, in a non-positively-locking fashion, from being displaced axially.

The above described joining process results in the finished constructed camshaft 1, it being possible for the bearing points 6 and the outer functional faces to be machined by means of known fine machining processes, for example by means of center-less cylindrical grinding for the bearing points 6 and cam shape grinding for the outer contour of the joined cam disks 3.

In the installed state in the internal combustion engine, the camshaft 1 preferably rotates in the same rotational direction under operating conditions as the drive wheel 4 does when it is assembled onto the cam disk support shaft 2. Accordingly, the camshaft drive torque is transmitted from drive wheel 4 to the cam disks 3 via the cam disk support shaft 2 in a positively locking fashion.

As an alternative to the described joining process, in which the drive wheel 4 is rotated relative to the cam disk support shaft 2, it would also be possible to rotate any desired cam disk 3. In addition, the drive wheel 4 and the cam disks 3 could be connected to the cam disk support shaft 2 individually, it being useful in this context to monitor the torque which is applied.

For clarity and to provide better understanding, the parameters, in particular the gradient of the wedge-shaped curve profile 9, the pitch of the elevations 7 and of the depressions 8, and the design of the tooth shapes, in the figures are selected to have extreme values. In practice, the wedge-shaped curve profile 9 would deviate less from a circular shape, with a smaller difference between the largest radius of the sections 2*a* and the smallest radius, that is to say a smaller gradient of the wedge-shaped curve profile 9, leading to better self-locking. The rotational angle $\phi 3$ can, however, reach a value of up to 180° and more.

What is claimed is:

1. A camshaft for an internal combustion engine comprising a cam disk support shaft (2), a plurality of cam disks (3), and a drive wheel (4) attached to the cam disk support shaft (2) at certain sections of the cam disk support shaft (2), the cam disk support shaft (2) having an outer radius which continuously changes in those sections in which the cam disks (3) are attached, and the cam disks having a bore whose inner radius varies continuously over the circumference of the bore, said the cam disk support shaft (2) being alternately provided with elevations (7) and depressions (8) in those sections (2*a*) in which the cam disks (3) are attached, said elevations (7) and depressions (8) forming a wedge-shaped curve profile (9) about the circumference of the attachment sections (2*a*) of the cam disk support shaft (2), the elevations (7) continuously enlarging the outer radius of the cam disk support shaft (2), the bore (5) of the cam disks (3) being matched to the enlarged portion of the outer radius of the cam disk support shaft (2), so that around the circumference of the cam disk support shaft (2) and the bore (5) of the cam disks (3), a wedge-shaped curve profile (9) is provided permitting joining of the cam disks (3) and the drive wheel (4) to the support shaft (2) by relative rotation therebetween.

2. The camshaft as claimed in claim 1, wherein the axial spacing (a) between two adjacent cam disks (3) is greater than the width (b) of a cam disk (3).

3. The camshaft as claimed in claim 1, wherein the bore (5) of the cam disks (3) has an inner profile which is mirror-inverted with respect to the inner profile of a respective bore (14) of the drive wheel (4).

4. The camshaft as claimed in claim 1, wherein the cam disk support shaft (2) is a solid shaft.

5. The camshaft as claimed in claim 1, wherein the cam disk support shaft (2) is a hollow shaft, a mandrel being inserted into the hollow shaft during manufacturing of the cam disk support shaft (2).

6. The camshaft as claimed in claim 1, wherein the depth of the depressions (8) increases continuously with the enlargement of the elevations (7).

7. The camshaft as claimed in one of claims 1, wherein the wedge-shaped curve profile (9) is embodied as one of an Archimedes and logarithmic spiral.

8. A method for producing a camshaft having a plurality of cam disks and at least one drive wheel attached to a cam disk support shaft, said method comprising the steps of forming alternate elevations (7) and depressions (8) in spaced sections (2*a*) of the cam disk support shaft (2), where the cam disks (3) are to be attached in such a way that the circumference of the sections (2*a*) of the cam disk support shaft (2) forms a wedge-shaped curve (9), with a continuously changing outer radius of the cam disk support shaft (2), so as to form in the cam disks (3) an envelope, defining a bore (5) which is matched to the enlarged portion of the outer radius of the cam disk support shaft (2), and attaching the cam disks (3) and the at least one drive wheel (4) to the cam disk support shaft (2) by means of rotation relative to one another, while at least one of the cam disks (3), the at least one drive wheel (4), and the cam disk support shaft (2) are elastically deformed.

9. The method as claimed in claim 8, wherein the cam disk support shaft (2) is plastically deformed when the cam disks (3) and the at least one drive wheel (4) are attached to the cam disk support shaft (2), the cam disks (3) and the at least one drive wheel (4) being elastically expanded.

10. The method as claimed in claim 8, in order to attach the cam disks (3) and the at least one drive wheel (4) to the cam disk support shaft (2), the drive wheel (4) is rotated while the cam disks (3) are held stationary.

11. The method as claimed in claim 8, wherein the elevations (7) and the depressions (8) are formed in the cam disk support shaft (2) by cold forming.

12. The method as claimed in claim 11, wherein the elevations (7) and the depressions (8) are formed in the cam disk support shaft (2) by means of two rod-shaped rolling dies (10, 11) which are moved relative to one another.

13. The method as claimed in claim 11, wherein the elevations (7) and the depressions (8) are formed in the cam disk support shaft (2) by means of swaging in a die (13).

14. The method as claimed in claim 8, wherein the cam disks (3) are produced by means of forging.

* * * * *